US006243477B1

(12) United States Patent
Ruiz

(10) Patent No.: US 6,243,477 B1
(45) Date of Patent: Jun. 5, 2001

(54) AUDIO SYSTEM WITH PARTITIONED INPUT AND OUTPUT COMPARTMENTS

(76) Inventor: Aldo M. Ruiz, 1822 W. Holland Dr., Tucson, AZ (US) 85746

( * ) Notice: Subject to any disclaimer, the term of this patent is extended or adjusted under 35 U.S.C. 154(b) by 0 days.

(21) Appl. No.: 09/084,334

(22) Filed: May 26, 1998

(51) Int. Cl.[7] ..... H04R 25/00

(52) U.S. Cl. ..... 381/351; 381/345; 381/354; 181/145; 181/146

(58) Field of Search ..... 381/345, 349, 381/351, 182, 186, 386, 388; 181/144, 145, 147, 155, 156, 199

(56) References Cited

U.S. PATENT DOCUMENTS

| | | | | |
|---|---|---|---|---|
| 4,837,837 | * | 6/1989 | Taddeo | 181/151 |
| 4,875,546 | * | 10/1989 | Krnan | 181/160 |
| 5,147,986 | * | 9/1992 | Cockrum et al. | 181/145 |
| 5,471,019 | * | 11/1995 | Maire | 181/156 |
| 5,714,721 | * | 2/1998 | Gawronski et al. | 181/156 |
| 5,895,896 | * | 4/1999 | Alton, Jr. | 181/145 |
| 6,014,448 | * | 1/2000 | Alton, Jr. | 381/351 |

* cited by examiner

*Primary Examiner*—Stella Woo
*Assistant Examiner*—P. Dabney
(74) *Attorney, Agent, or Firm*—Antonio R. Durando

(57) ABSTRACT

An audio system has a cabinet with several partitions. The partitions divide the interior of the cabinet into compartments. These include an input compartment, an output compartment above the input compartment, an outer compartment to one side of the input and output compartments, and an intermediate compartment between the outer compartment and the input and output compartments. Two tweeters are mounted one above the other in the outer compartment as are two midrange speakers. The outputs of the midrange speakers open into the intermediate compartment while the outputs of the tweeters open to the atmosphere. A woofer or subwoofer is mounted on a partition which borders the input compartment, and the output of the woofer or subwoofer opens into the input compartment. The output compartment is provided with a port, and a pair of pipes connects the input compartment with the output compartment. High-frequency components of the sound emitted by the woofer or subwoofer are largely eliminated by conducting the sound to the output compartment via the pipes.

14 Claims, 3 Drawing Sheets

AUDIO SYSTEM WITH PARTITIONED INPUT AND OUTPUT COMPARTMENTS

BACKGROUND OF THE INVENTION

1. Field of the Invention

The invention relates to an audio system.

2. Description of the Prior Art

In an audio system having a tweeter and a subwoofer, the sound quality is enhanced when the input to the tweeter is restricted to low frequencies and the input to the subwoofer is restricted to high frequencies. This can be achieved by a 2-way crossover.

A design known as the bandpass subwoofer employs an enclosure which makes a crossover unnecessary. A partition inside the enclosure divides the interior of the enclosure into two compartments. One of the compartments is completely sealed while the other contains a vent or port which opens to the atmosphere. One or more woofers are mounted on the partition. The bandpass subwoofer is used in conjunction with satellite speakers to form a total audio system.

A modified audio system contains a bass module in which two partitions divide the interior of an enclosure into a central compartment flanked by two end compartments. A pair of woofers is mounted in the central compartment on one of the partitions, and the outputs of the woofers face the end compartment bounded by this partition. The other end compartment is provided with a vent or port which opens to the atmosphere.

Although the known audio systems generally have good sound quality, a further improvement is nevertheless desirable.

SUMMARY OF THE INVENTION

It is an object of the invention to enhance the sound quality of an audio system.

The preceding object, as well as others which will become apparent as the description proceeds, are achieved by the invention.

One aspect of the invention resides in an audio system. The system comprises a housing defining a chamber, and partitioning means in the chamber cooperating with the housing to divide the chamber into compartments including an input compartment and an output compartment. The system further comprises at least one sound generator having an output to the input compartment, and means establishing at least one unobstructed path between the input compartment and the output compartment.

It has been found that, when sound is allowed to travel between two compartments along an unobstructed path, the quality of the sound can be improved. For instance, high-frequency components of the sound from a woofer or subwoofer can be largely eliminated by directing the sound from one compartment to another along an unobstructed path.

Another aspect of the invention resides in a method of enhancing audio. The method comprises the steps of providing sound to a first compartment, and conducting at least a portion of the sound to a second compartment along an unobstructed path.

The conducting step may involve passing the sound through a constriction.

Additional features and advantages of the invention will be forthcoming from the following detailed description of preferred embodiments when read in conjunction with the accompanying drawings.

DESCRIPTION OF THE PREFERRED EMBODIMENTS

Figure 1:
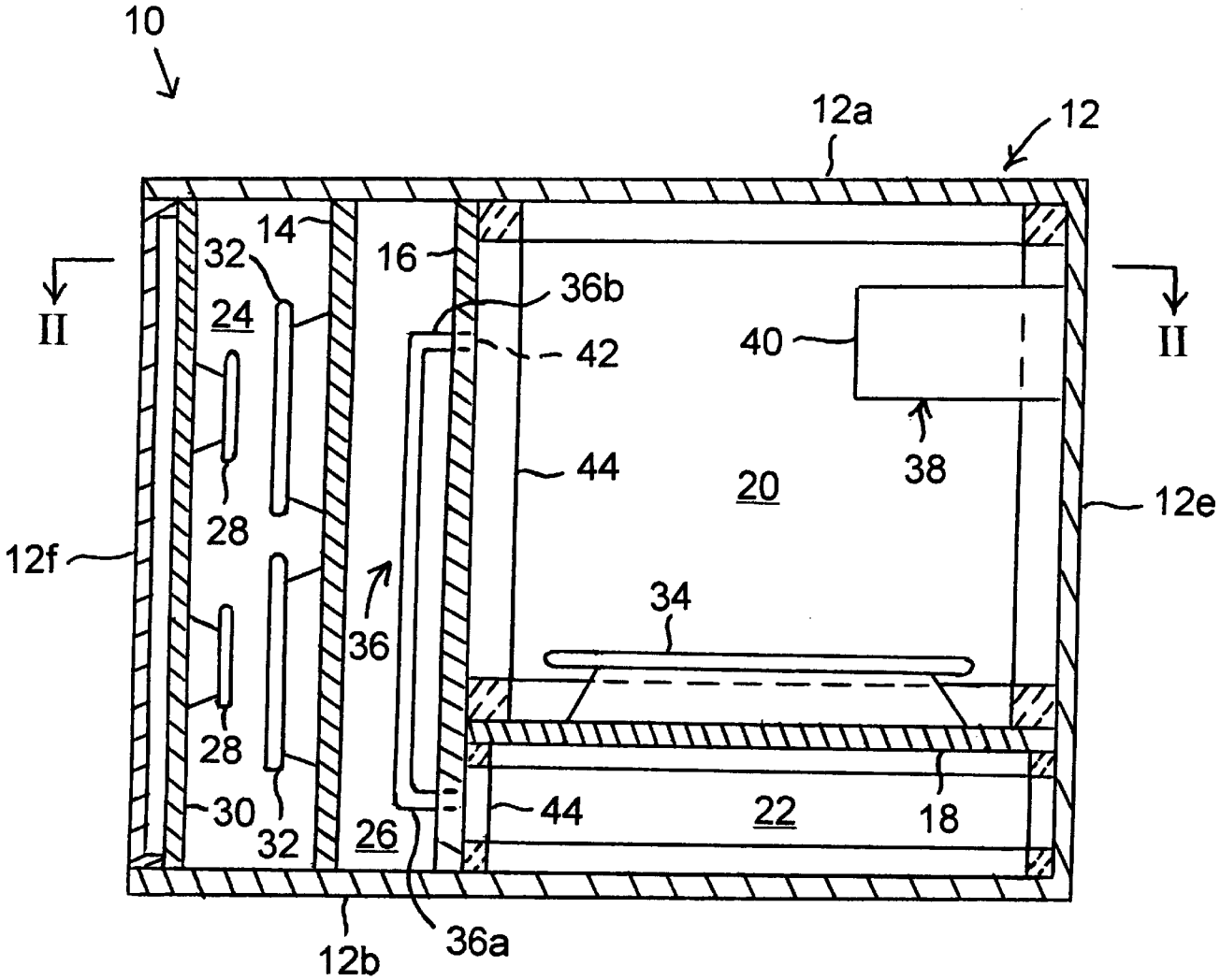
FIG. 1 is a longitudinal vertical sectional view of one embodiment of an audio system in accordance with the invention.
Figure 2:
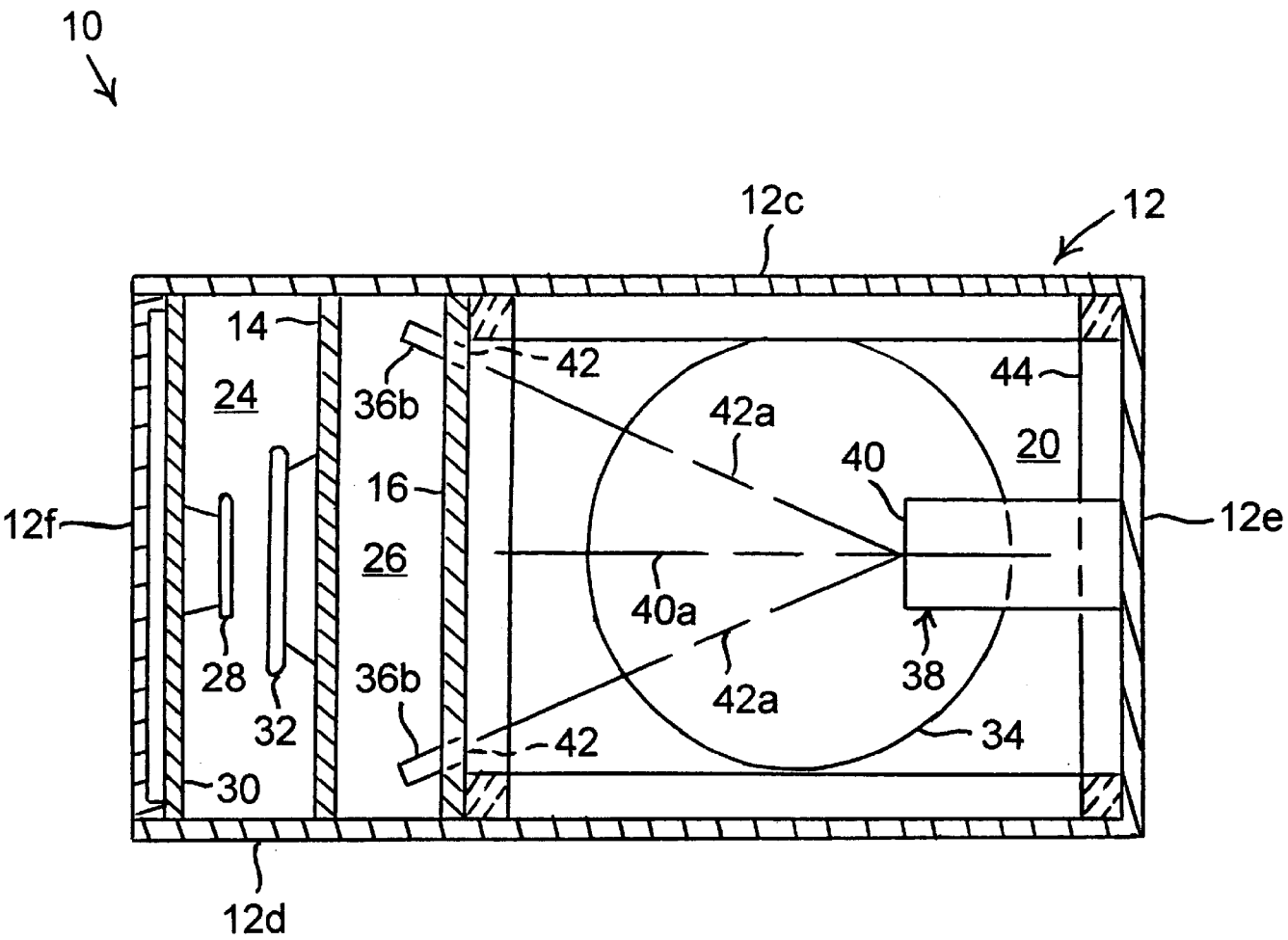
FIG. 2 is a sectional view of the audio system as seen in the direction of the arrows II—II of FIG. 1.

Referring to FIGS. 1 and 2, the numeral 10 identifies an audio system in accordance with the invention. The audio system 10 includes a rectangular or square housing or cabinet 12 having a top wall 12*a*, a bottom wall 12*b*, side walls 12*c* and 12*d*, and end walls 12*e* and 12*f*. The top wall 12*a*, bottom wall 12*b*, side walls 12*c*,12*d* and end wall 12*e* are constituted by sheets of wood, plastic or fiberboard while the end wall 12*f* is constituted by a plastic or metal grille. The top wall 12*a*, bottom wall 12*b*, side walls 12*c*,12*d* and end wall 12*e* are connected to one another so as to form a rigid unit whereas the grille 12*f* is separate from the top wall 12*a*, bottom wall 12*b*, side walls 12*c*,12*d* and end wall 12*e*. The top wall 12*a*, bottom wall 12*b* and side walls 12*c*,12*d* define an opening, and the grille 12*f* is receivable in the opening with a friction fit.

The top wall 12*a*, bottom wall 12*b*, side walls 12*c*,12*d*, end wall 12*e* and grille 12*f* cooperate to form a chamber internally of the housing 10. A vertical partition 14 is mounted in the chamber parallel to the end wall 12*e* and grille 12*f*, and the partition 14 extends between the top wall 12*a* and bottom wall 12*b* as well as between the side walls 12*c*,12*d*. A second vertical partition 16 is mounted in the chamber parallel to the vertical partition 14 and is located between the latter and the end wall 12*e*. The vertical partition 16 again extends between the top wall 12*a* and bottom wall 12*b* as well as between the side walls 12*c*,12*d*.

A horizontal partition 18 is also mounted in the chamber of the housing 10 parallel to the top wall 12*a* and bottom wall 12*b*. The horizontal partition 18 extends between the end wall 12*e* and the vertical partition 16 as well as between the side walls 12*c*,12*d*.

The partitions 14,16,18 can be constituted by panels of wood, plastic or fiberboard.

The horizontal partition 18 and vertical partition 16 cooperate with the top wall 12*a*, bottom wall 12*b*, side walls 12*c*,12*d* and end wall 12*e* to form an upper compartment 20 and a lower compartment 22 within the chamber of the housing 10. The vertical partition 14 cooperates with the top wall 12*a*, bottom wall 12*b*, side walls 12*c*,12*d* and grille 12*f* to define an outer compartment 24 within the chamber of the housing 10. Furthermore, the vertical partition 14 and vertical partition 16 cooperate with the top wall 12*a*, bottom wall 12*b* and side walls 12*c*,12*d* to form an intermediate compartment 26 within the chamber of the housing 10.

The upper and lower compartments 20,22 are located at one end of the housing 10 while the outer compartment 24 is located to the 20 side of the upper and lower compartments 20,22 at the opposite end of the housing 10. The intermediate compartment 26 is disposed to the side of the upper and lower compartments 20,22 between the outer compartment 24 and the two compartments 20,22.

The audio system 10 has five speakers. These include a pair of tweeters 28 in the outer compartment 24. The tweeters 28 are mounted one above the other on a carrier 30 in the form of a panel, and the tweeters 28 are located on the side of the carrier 30 remote from the grille 12*f*. The outputs of the tweeters 28 face the grille 12*f* and thus in the opposite direction from the upper and lower compartments 20,22. The carrier 30 has an opening in register with the output of each tweeter 28.

The speakers in the audio system 10 further include two midrange speakers 32 which are also disposed in the outer compartment 24. The midrange speakers 32 are mounted one above the other on the vertical partition 14, and the outputs of the speakers 32 face the intermediate compartment 26 and the upper and lower compartments 20,22. The vertical partition 14 has an opening in alignment with the output of each midrange speaker 32.

The fifth speaker in the audio system 10 is a woofer or subwoofer 34 in the upper compartment 20. The woofer or subwoofer 34 is mounted on the horizontal partition 18, and the output of the woofer or subwoofer 34 faces the lower compartment 22. The horizontal partition 18 has an opening in register with the output of the woofer or subwoofer 34.

Two pipes 36 of constant inner diameter are mounted next to one another on the vertical partition 16. Each pipe 36 has an input end 36*a* which communicates with the lower compartment 22 via a respective opening in the vertical partition 16. Furthermore, each pipe 36 has an output end 36*b* which communicates with the upper compartment 20 via a respective opening in the vertical partition 16. The two pipes 36 define two constricted but unobstructed or free paths between the lower compartment 22 and the upper compartment 20. The pipes 36 constitute constrictions because the cross-sectional areas of the pipes 36 are much smaller than the cross-sectional area of either the lower compartment 22 or the upper compartment 20.

A cylinder 38 is mounted on the end wall 12*e* in the upper compartment 20. The cylinder 38 has a passage of circular cross section which establishes communication between the upper compartment 20 and the atmosphere. The cylinder 38 constitutes a port or vent for, and serves as an output of, the upper compartment 20.

The cylinder 38 is horizontal and extends from the end wall 12*e* partway to the vertical partition 16. The cylinder 38 is disposed midway between the side walls 12*c*,12*d*, and one of the pipes 36 is located to either side of the cylinder 38 as seen in FIG. 2.

The cylinder 38 is provided with an input opening or inlet opening 40 having an axis 40*a* while the output end 36*b* of each pipe 36 is provided with an output opening or outlet opening 42 having an axis 42*a*. The output ends 36*b* of the pipes 36 are located at the level of the cylinder 38 and are mounted on the vertical partition 16 so that the axes 42*a* of the output openings 42 pass through the input opening 40 of the cylinder 38. The arrangement is preferably such that the axes 42*a* of the output openings 42 intersect the axis 40*a* of the input opening 40. The three axes 40*a*,42*a* advantageously intersect at a common point in or near the input opening 40.

The amount of resonance is a function of the length of the cylinder 38. It is preferred to select this length so that resonance is minimized. The length of the cylinder 38 at which resonance is minimized can be calculated in a conventional manner.

When the audio system 10 is operated, the tweeters 28 emit sound into the outer compartment 24 while the midrange speakers 32 emit sound into the intermediate compartment 26. The sound emitted by the tweeters 28 travels to the atmosphere via the grille 12*f* whereas the sound emitted by the midrange speakers 32 enters the atmosphere through the top wall 12*a* and side walls 12*c*,12*d* of the housing 10. By making the compartment 26 small, the midrange speakers 32 can be caused to be out of phase.

The woofer or subwoofer 34 emits sound into the lower compartment 22, and part of this sound is transmitted to the atmosphere via the side walls 12*c*,12*d* and end wall 12*e* of the housing 10. On the other hand, part of the sound emitted into the lower compartment 22 by the woofer or subwoofer 34 is conducted through the pipes 36 to the upper compartment 20. The sound entering the upper compartment 20 exits to the atmosphere mainly via the cylinder 38.

The lower compartment 22 constitutes an input compartment for the bass generated by the woofer or subwoofer 34. On the other hand, the upper compartment 20 constitutes an output compartment for the part of the bass which travels from the lower compartment 22 to the upper compartment 20 through the pipes 36.

By conducting sound from the lower compartment 22 to the upper compartment 20 via the pipes 36, it becomes possible to eliminate a large proportion of the high-frequency components of the sound. This results in a richer bass from the woofer or subwoofer 34 and enhances the sound quality of the audio system 10.

The sound quality of the audio system 10 may be further enhanced by placing sound insulation 44 in the corners of the upper compartment 20 and lower compartment 22. The sound insulation 44 may run along the corners for the lengths, heights and widths of the compartments 20,22. The sound insulation 44 preferentially absorbs the high-frequency components of the sound generated by the woofer or subwoofer 34 and inhibits formation of the standing waves which tend to develop in small square or rectangular compartments.

The pipes 36 enable the air in the lower compartment 22 to remain in constant motion during operation of the audio system 10. This helps to additionally reduce standing waves so that these are largely if not completely eliminated. Due to air movement, standing waves which may develop in the lower compartment 22 enter the pipes 36 and are conducted to the upper compartment 20. Since the output openings 42 of the pipes 36 face the input opening 40 of the cylinder 38, the waves travel through the upper compartment 20 into the cylinder 38 where, as is known, standing waves are unable to exist.

Standing waves which may form in the upper compartment 20 are conveyed to the lower compartment 22 via the pipes 36. The waves entering the lower compartment 22 are either absorbed by the insulation 44 in the compartment 22 or are eliminated due to the opening formed in the horizontal partition 18 in register with the output of the woofer or subwoofer 34.

In a currently preferred embodiment of the audio system 10, the distance between the top wall 12*a* and the horizontal partition 18 is 8 inches while the distance between the horizontal partition 18 and the bottom wall 12*b* is 2 inches. The distance between the end wall 12*e* and the vertical partition 16 is 8.5 inches. The length of the cylinder 38 is 5 inches and the inner diameter of the cylinder 38 is 3 inches. The tweeters 28 are constituted by 1 inch speakers, the midrange speakers 32 by 4 inch speakers and the woofer or subwoofer 34 by an 8 inch speaker. The inner diameter of each pipe 36 is 0.75 inch.

Figure 3:
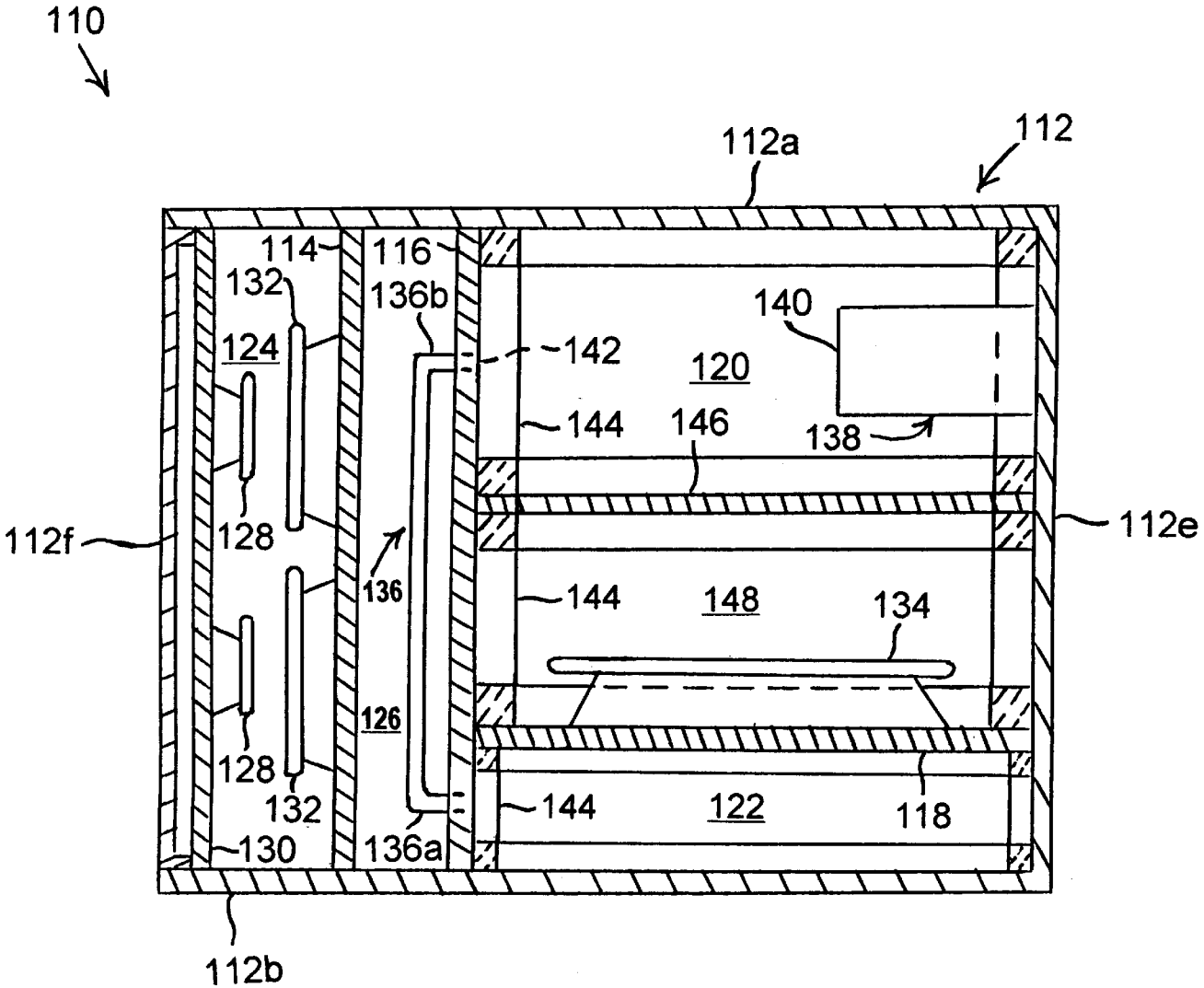
FIG. 3 is a view similar to FIG. 1 of another embodiment of an audio system according to the invention.

Turning to FIG. 3, the same numerals as in FIGS. 1 and 2, plus 100, are used to identify similar elements.

The audio system 110 of FIG. 3 differs from that of FIGS. 1 and 2 in that a horizontal partition 146 is mounted between the cylinder 138 and the woofer or subwoofer 134. The horizontal partition 146, which is parallel to the top wall 112*a* and bottom wall 112*b* of the housing 112, extends between the end wall 112*e* and the vertical partition 116 as well as between the side walls of the housing 112. The horizontal partition 146 cooperates with the side walls, the end wall 112*e*, the vertical partition 116 and the horizontal partition 118 to define a compartment 148 between the upper compartment 120 and the lower compartment 122.

The pipes 36,136 of the audio systems 10,110 make it possible to eliminate a large proportion of the high-frequency components of the sound emitted by the woofers or subwoofers 34,134. This enables the bass generated by the woofers or subwoofers 34,134 to be enriched thereby improving the sound quality of the audio systems 10,110.

The arrangement of the tweeters 28,128 and the midrange speakers 32,132 allows the sound quality of the audio systems 10,110 to be further enhanced and also permits the audio systems 10,110 to have a compact construction.

Various modifications are possible within the meaning and range of equivalence of the appended claims.

I claim:

1. An audio system comprising:

a housing defining a chamber;

partitioning means in said chamber cooperating with said housing to divide said chamber into compartments including an input compartment and an output compartment;

at least one sound generator having an output to said input compartment; and means establishing at least one unobstructed path between said input compartment and said output compartment;

wherein at least one of said compartments has a corner further comprising sound-absorbing material in said corner; and wherein said housing and said partitioning means cooperate to define a first additional compartment and a second additional compartment laterally of said input compartment and said output compartment, said partitioning means including a partition which is located between and adjoins said first additional compartment and said second additional compartment; and further comprising at least one additional sound generator on said partition.

2. The system of claim 1, wherein said partitioning means comprises an additional partition which adjoins said input compartment, said output compartment and one of said additional compartments, said establishing means including at least one pipe in said one additional compartment, and said pipe having an input end which opens to said input compartment and an output end which opens to said output compartment.

3. The system of claim 2, further comprising at least one additional sound generator in the other of said additional compartments.

4. An audio system comprising:

a housing defining a chamber;

partitioning means in said chamber cooperating with said housing to divide said chamber into compartments including an input compartment and an output compartment;

at least one sound generator having an output to said input compartment; and means establishing at least one unobstructed path between said input compartment and said output compartment;

wherein said housing and said partitioning means cooperate to define at least one additional compartment laterally of said input compartment and said output compartment, and the audio system comprises at least one additional sound generator in said one additional compartment; and wherein the audio system further comprises a second additional sound generator in said one additional compartment, said second additional sound generator being different from said one additional sound generator, and said additional sound generators having respective outputs which face in different directions.

5. The system of claim 4, wherein said partitioning means comprises at least one partition between said input compartment and said output compartment, said one sound generator being mounted on said one partition.

6. The system of claim 4, wherein said one sound generator comprises a woofer or subwoofer.

7. The system of claim 4, wherein said establishing means comprises at least one pipe having an input end which opens to said input compartment and an output end which opens to said output compartment.

8. The system of claim 7, wherein said one pipe is located externally of said input compartment and said output compartment substantially in its entirety.

9. The system of claim 7, wherein said output compartment is provided with at least one output which is spaced from said output end transversely of said output compartment, said one output having an inlet opening with a first axis, and said output end having an outlet opening with a second axis which intersects said first axis in the region of said inlet opening.

10. The system of claim 4 wherein said partitioning means comprises a partition which is located between and adjoins said input compartment and said output compartment, said one sound generator being mounted on said partition in said output compartment.

11. The system of claim 4, wherein said partitioning means comprises a plurality of partitions which cooperate with said housing to define said input compartment, said output compartment and at least one additional compartment between said input compartment and said output compartment, one of said partitions being located between and adjoining said input compartment and said additional compartment, and said one sound generator being mounted on said one partition in said additional compartment.

12. The system of claim 4, wherein said establishing means include at least one pipe in said one additional compartment, and said pipe have an input end which opens to said input compartment and an output end which opens to said output compartment.

13. The system of claim 4, wherein one of said additional sound generators comprises a mid-range speaker and the other of said additional sound generators comprises a tweeter.

14. The system of claim 4, wherein the output of one of said additional sound generators faces said input compartment and said output compartment, the output of the other of said additional sound generators facing away from said input compartment and said output compartment.

* * * * *